US007845772B2

(12) United States Patent
Kamei

(10) Patent No.: US 7,845,772 B2
(45) Date of Patent: Dec. 7, 2010

(54) ACTUATOR DEVICE AND LIQUID EJECTING HEAD

(75) Inventor: Hiroyuki Kamei, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 656 days.

(21) Appl. No.: 11/858,969

(22) Filed: Sep. 21, 2007

(65) Prior Publication Data

US 2008/0252697 A1 Oct. 16, 2008

(30) Foreign Application Priority Data

Sep. 21, 2006 (JP) ..... 2006-256201

(51) Int. Cl.
*B41J 2/045* (2006.01)

(52) U.S. Cl. ..... 347/71

(58) Field of Classification Search ..... 347/68, 347/70–72; 310/320; 29/25.35
See application file for complete search history.

(56) References Cited

U.S. PATENT DOCUMENTS 7,137,179 B2 * 11/2006 Yokouchi et al. ..... 29/25.35
7,497,962 B2 * 3/2009 Tokunaga ..... 216/27
2005/0167712 A1 * 8/2005 Kijima et al. ..... 257/295

FOREIGN PATENT DOCUMENTS

JP 2005-071945 3/2004
JP 2005-176433 6/2005

* cited by examiner

*Primary Examiner*—An H Do
(74) *Attorney, Agent, or Firm*—Workman Nydegger

(57) ABSTRACT

An actuator device includes a piezoelectric element configured to include a lower electrode provided on a surface side of a substrate, a piezoelectric layer provided on the lower electrode, and an upper electrode provided on the piezoelectric layer. The lower electrode contains a precious metal. When a cross-section of the lower electrode is examined in the thickness direction using secondary ion mass spectroscopy (SIMS), a ratio $Z_1/Z_2$ between the intensity $Z_1$ of oxygen ions and the intensity $Z_2$ of ions of a precious metal detected at the surface of the lower electrode facing the substrate is 0.2 or more.

8 Claims, 11 Drawing Sheets

ACTUATOR DEVICE AND LIQUID EJECTING HEAD

BACKGROUND

The entire disclosure of Japanese Patent Application No. 2006-256201, filed Sep. 21, 2006 is expressly incorporated herein by reference.

1. Technical Field

The present invention relates to actuator devices for liquid ejecting heads. More specifically, the present invention relates to an actuator device comprising a piezoelectric element, which is configured to include a lower electrode, a piezoelectric layer made of a piezoelectric material, and an upper electrode formed on a vibrating plate.

2. Related Art

Typically, an actuator device of a liquid ejecting head includes a piezoelectric element comprising a piezoelectric layer formed of a piezoelectric material with an electromechanical conversion function, such as a crystallized piezoelectric ceramic. The piezoelectric layer is interposed between two electrodes, a lower electrode and an upper electrode. Such actuator devices are generally called flexural vibration mode actuator devices and are mounted in liquid ejecting heads. An example of a liquid ejecting head is an ink jet recording head wherein a portion of a pressure generating chamber communicates with a nozzle opening for ejecting ink droplets. The ink jet recording head is formed using a vibrating plate which is vibrates in response to a piezoelectric element in order to apply pressure to ink in the pressure generating chamber and thereby discharge ink droplets through the nozzle opening. Generally, the piezoelectric element is manufactured by forming a piezoelectric layer and an upper electrode layer on the surface of a substrate provided with a lower electrode. The layers are created using a film formation technique and then using lithography to cut the piezoelectric layer and the upper electrode layer into shapes which correspond to the pressure generating chambers so as to form a plurality of independent pressure generating chambers.

One difficulty in the current configuration of the actuator device, however, is that since the actuator device is repeatedly driven in the ink recording process, there lower electrode layer may peel off from the its base. In order to solve this problem, Japanese Patent Application No. JP-A-2005-176433 discloses an actuator with improved adhesion between the insulating layer and a lower electrode, created by improving the crystallinity of the insulating layer. In one example, the insulating layer includes a crystal plane of zirconium oxide ($ZrO_2$) oriented in the (−111) direction.

However, in order to improve the durability and reliability of the actuator device, the adhesion between the layers much be further improved.

BRIEF SUMMARY OF THE INVENTION

An advantage of some aspects of the invention is that it provides an actuator device with improved adhesion properties between a lower electrode and its base.

One aspect of the invention is an actuator device including a piezoelectric element. The piezoelectric element comprises a lower electrode provided on a surface of a substrate, a piezoelectric layer provided on the lower electrode, and an upper electrode provided on the piezoelectric layer. The lower electrode is comprised of a precious metal. The surface of the lower electrode facing the substrate has a ratio $Z_1/Z_2$ between the intensity $Z_1$ of oxygen ions and the intensity $Z_2$ of ions of a precious metal on of the lower electrode facing the substrate is 0.2 or more when a cross-section of the lower electrode is examined using secondary ion mass spectroscopy (SIMS).

Another aspect of the invention is a liquid ejecting head including the actuator device described above. The liquid ejecting head acts as a liquid discharging unit that ejects liquid.

Advantageously, in the actuator device described above the ratio of oxygen ions to ions of a precious metal detected at the boundary of the lower electrode facing the substrate is 0.2 or more, meaning that the adhesion between the lower electrode and layer in contact with the lower electrode is high. Thus, the peeling of the lower electrode from the substrate is suppressed, and an actuator device which is more durable and reliable than currently found in the art may be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described in detail.

First Embodiment

Figure 1:
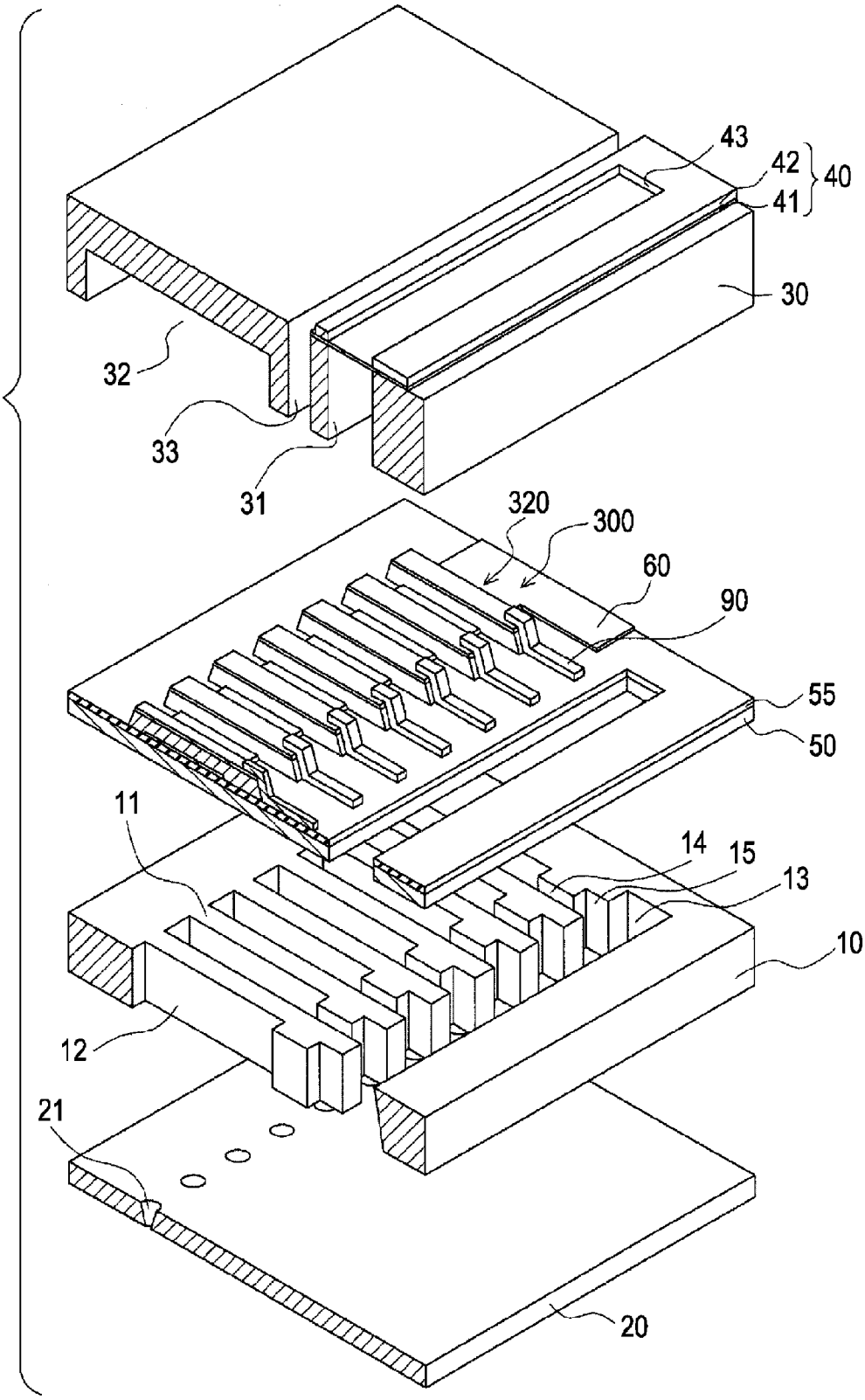
FIG. 1 is an exploded perspective view illustrating the configuration of a recording head according to an embodiment of the invention.
Figure 2:
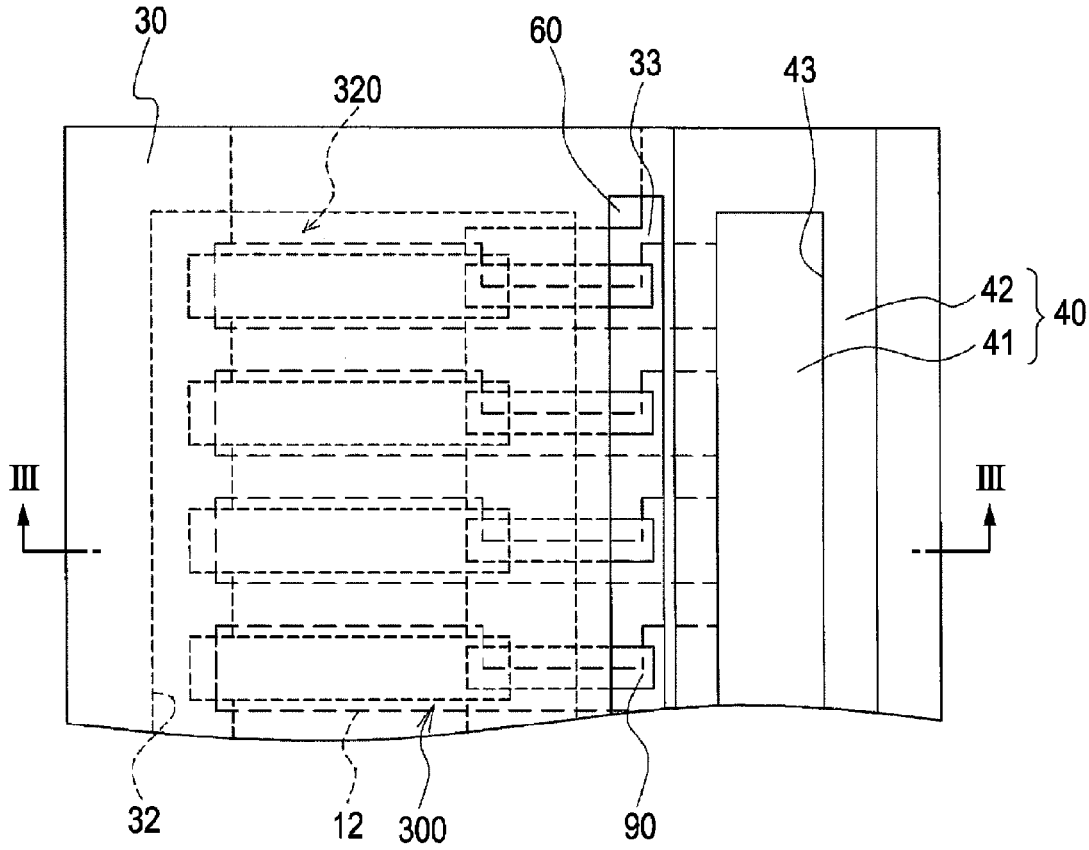
FIG. 2 is a plan view illustrating main portions of the recording head according to an embodiment of the invention.
Figure 3:
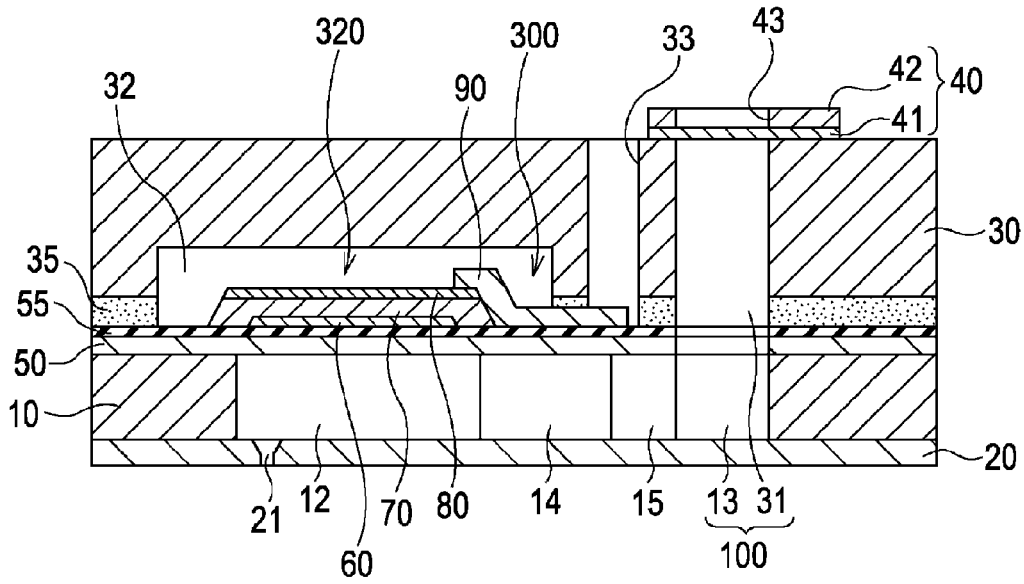
FIG. 3 is a cross-sectional view illustrating the recording head according to an embodiment of the invention.

FIG. 1 is an exploded perspective view schematically illustrating the configuration of an ink jet type recording head, which serves as an example of a liquid ejecting head having an actuator device according to a first embodiment of the invention. FIG. 2 is a plan view illustrating main portions of the ink jet type recording head, and FIG. 3 is a cross-sectional view taken along the line III-III of FIG. 2.

As shown in the drawings, substrate 10 including a plurality of passages is formed of a single crystal silicon substrate. An elastic layer 50 of silicon dioxide formed by thermal oxidation to a thickness of between 0.5 to 2 μm is formed the surface of the substrate 10. Within the substrate 10, a plurality of pressure generating chambers 12 separated by partition walls 11 are provided. Moreover, at one end of the substrate 10 are ink supply passages 14 and communicating passages 15, for supplying ink into the pressure generating chambers 12. In addition, a communicating portion 13 which forms a portion of a reservoir 100 (shown in FIG. 2) serving as a common ink chamber (liquid chamber) is formed at one end of the communicating passages 15 supplying in to the pressure generating chambers 12 via the ink supply passages 14 and communicating passages 15. That is, a liquid passage is formed in the passage forming substrate 10, which includes the pressure generating chambers 12, the communicating portion 13, the ink supply passages 14, and the communicating passages 15.

Each of the ink supply passages 14 communicates with one end of a corresponding pressure generating chamber 12 and has area smaller than the pressure generating chambers 12. In the present embodiment, the ink supply passages 14 are formed so as to have a width which is smaller than the pressure generating chambers 12 by narrowing a passage between the reservoir 100 and the pressure generating chambers 12. As described above, in this embodiment, the ink supply passages 14 are formed by reducing the width of each of the passages on one side. However, the ink supply passages may be formed by reducing the width of the passages from both sides, or by reducing the height of the passages in the vertical direction. Furthermore, each communicating passage 15 communicates with a side of the ink supply passage 14 which is opposite to the pressure generating chamber 12. Each communicating passage 15 has a sectional area which is larger than the ink supply passage 14. In the example shown in FIG. 1, the communicating passages 15 have the same sectional area as the pressure generating chambers 12.

Thus, the ink supply passages 14 each have a smaller width than the pressure generating chambers 12. The width of the communicating passages 15 is larger than the ink supply passages 14 and equal to the pressure generating chambers 12. These passages are provided on the passage forming substrate 10 and are separated by the plurality of partition walls 11.

In addition, a nozzle plate 20 is fixed on a surface of the substrate 10 using an adhesive or a heat sealing layer. The nozzle plate 20 includes nozzle openings 21, which are formed so as to communicate with portions of the pressure generating chambers 12 opposite the ink supply passages 14. In one example, the nozzle plate 20 is formed with a thickness of between 0.01 mm and 1 mm using a glass ceramic, a single crystal silicon substrate, or a stainless steel having a coefficient of linear expansion of 2.5 to 4.5[$\times 10^{-6}$/° C.] at 300° C. or less.

In contrast, the elastic layer 50 is formed on the opposite surface of the substrate 10. In one example, the elastic layer 50 is made from a silicon dioxide and has a thickness of about 1.0 μm. In this example, an insulating layer 55 is formed on the elastic layer 50 and is made of a zirconium oxide ($ZrO_2$) with a thickness of 0.3 to 0.4 μm. The type of layer provided on the passage forming substrate 10 is not specifically limited to the examples above, meaning that the layers may be formed of different materials including an oxide, an $SiO_2$, a $ZrO_2$, a $Zr_{1-x}M_xO_Y$ material (where $0.01 \leqq X \leqq 0.15$, $Y=2.0\pm\alpha$, $\alpha$ is a stoichiometrically allowed value, and M is an IIA group element, an IIIA group element, or an IIIB group element of the periodic table, preferably, M is at least one selected from Y and Ca), or combination of the above. In the case when a $ZrO_2$ layer is provided as the insulating layer 55, it is preferable that a plane of columnar crystal is formed in the (−111) direction having an average crystal grain diameter of 20 to 100 nm. One advantage of using the $ZrO_2$ layer is that the surface of the layer is smooth, meaning that the adhesion between the $ZrO_2$ layer and upper and lower layers located on and below the $ZrO_2$ layer can be improved. The improved adhesion means that the peeling of each layer is suppressed, resulting in an actuator device with excellent durability and reliability.

In this example, the layer includes a columnar crystal with a plane oriented in a parallel direction to the electrode layer. The average crystal grain diameter of the crystal is calculated using image processing for an image obtained by using SEM or AFM.

The exemplary embodiment of the invention also includes a piezoelectric element 300 including a lower electrode layer 60 having a thickness of about 0.1 to 0.3 μm, a piezoelectric layer 70 having a thickness of about 0.5 to 5 μm, and an upper electrode layer 80 formed on the insulating layer 55 having a thickness of about 10 to 200 nm.

Figure 8A:
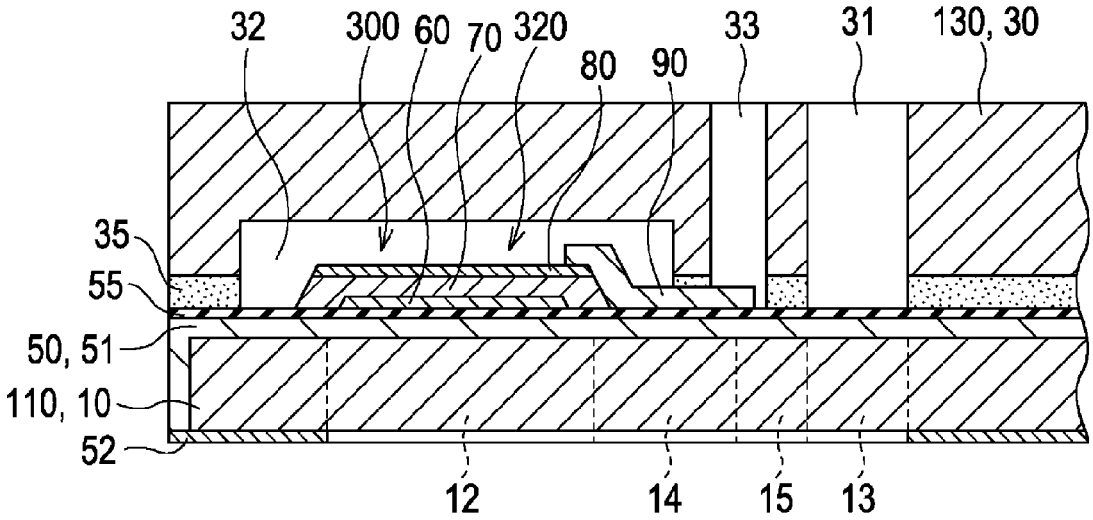
FIG. 8A-8B are cross-sectional views illustrating a process of manufacturing the recording head according to the first embodiment of the invention.
Figure 8B:
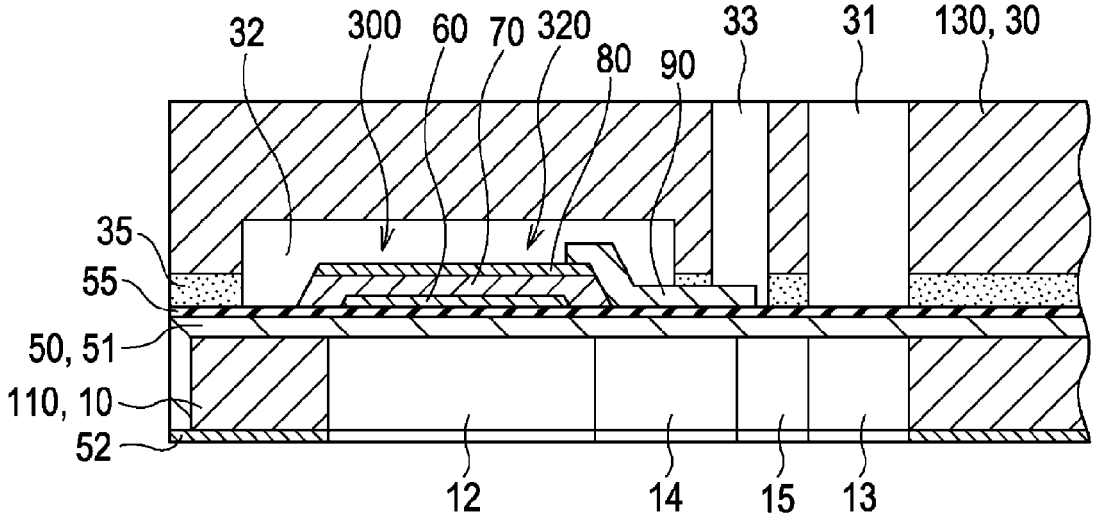

Here, the piezoelectric element 300 refers to the portion comprising the lower electrode layer 60, the piezoelectric layer 70, and the upper electrode layer 80 shown in FIG. 8B. In general, one of the electrodes of the piezoelectric element 300 is used as a common electrode, and the other electrodes and the piezoelectric layer 70 are created to correspond to each pressure generating chamber 12. Furthermore, a portion comprising the patterned electrode and the piezoelectric layer 70 wherein piezoelectric distortion occurs due to application of a voltage to both electrodes is referred to as a piezoelectric active portion 320. Although the lower electrode layer 60 is used as the common electrode and the upper electrode layer 80 is used as an individual electrode of the piezoelectric element 300 in the present embodiment, a different configuration may be adopted wherein the upper electrode layer is the common electrode and the lower electrode layer is the individual electrode of the piezoelectric element 300. In any case, a piezoelectric active portion 320 is formed for each pressure generating chamber 12. Furthermore, in the present embodiment, the lower electrode layer 60, the piezoelectric layer 70, and the upper electrode layer 80 are created with inclined edges, such that the widths are decreased on the upper electrode layer 80 side, as shown in FIG. 3. In this example, the piezoelectric element 300 and a vibrating plate capable of moving when driven by the piezoelectric element 300 are referred to as an actuator device.

In this embodiment, the elastic layer 50, the insulating layer 55, and the lower electrode layer 60 act as a vibrating plate. However, the invention is not limited to the configuration shown in FIG. 3, and many configurations may be used without deviating from the meaning and scope of the invention. For example, only the lower electrode layer 60 may act as the vibrating plate without requiring an elastic layer 50 or insulating layer 55.

Figure 11:
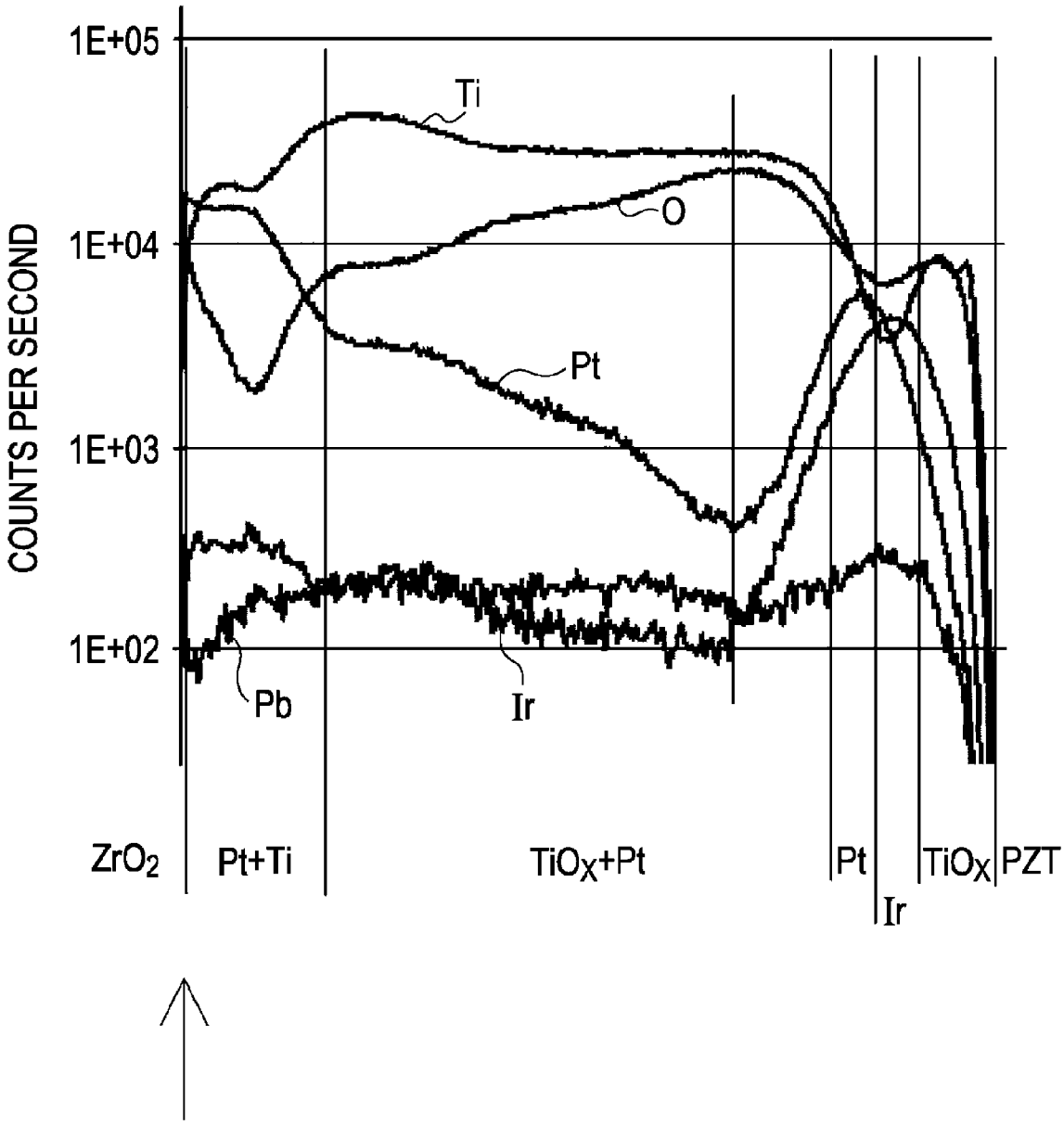
FIG. 11 is a view illustrating a result of measurement of a lower electrode layer using SIMS in a first example.

In one configuration, the lower electrode layer 60 contains precious metals. Moreover, when a cross-section of the lower electrode layer 60 is examined using secondary ion mass spectroscopy (SIMS), O ions and ions of precious metals are detected near the adjoining surfaces (indicated by arrow in FIG. 11) of the lower electrode layer 60 and the insulating layer 55 as shown in FIG. 11. In one embodiment, the ratio $Z_1/Z_2$ is 0.2 or more, or more preferably 0.5 or more, wherein $Z_1$ is the intensity of O ions and $Z_2$ is the intensity of ions of precious metals. In embodiments where the ratio is greater than 0.2, the adhesion between the lower electrode layer 60 and the insulating layer 55 is noticeably improved, as illustrated in the following examples. As a result of the improved adhesion between the layers, it is possible to prevent the lower electrode layer 60 from being peeled off from the insulating layer 55.

Precious metals that may be used in the lower electrode layer 60 include a platinum group (Ru, Rh, Pd, Os, Ir, and Pt), gold, silver, or some combination of the above. In cases where a plurality of precious metals are used, the precious metal ions are detected near the surface of the lower electrode layer 60 and the insulating layer 55 when measured using SIMS. In such configurations, if the ratio $Z_1/Z_3$ between the intensity of O ions and the intensity $Z_3$ (intensity of a precious metal that is detected to be highest among ions of those precious metals) is 0.2 or more, the adhesion between the insulating layer 55 and the lower electrode layer 60 will be increased. For example, in the case when the lower electrode layer 60 contains Pt, Ir, Ti, and $TiO_X$ ($0.1 \leqq x \leqq 2$), the adhesion between the insulating layer 55 and the lower electrode layer 60 may be increased by achieving a ratio between O ions and Pt ions near the adjoining surfaces of the lower electrode layer 60 and the insulating layer 55 within the range described above.

In addition, other examples of materials (piezoelectric materials) that may be used to form the piezoelectric element 300 in the present embodiment include a ferroelectric piezoelectric material, such as a lead zirconate titanate (PZT), and a relaxor ferroelectric material added with a metal, such as niobium, nickel, magnesium, bismuth or yttrium. Exemplary compositions include, for example, $PbTiO_3$(PT), $PbZrO_3$ (PZ), $Pb(Zr_xTi_{1-x})O_3$ (PZT), $Pb(Mg_{1/3}Nb_{2/3})O_3$—$PbTiO_3$ (PMN-PT), $Pb(Zn_{1/3}Nb_{2/3})O_3$—$PbTiO_3$(PZN-PT), $Pb(Ni_{1/3}Nb_{2/3})O_3$—$PbTiO_3$(PNN-PT) $Pb(In_{1/2}Nb_{1/2})O_3$—$PbTiO_3$ (PIN-PT), $Pb(Sc_{1/2}Ta_{1/2})O_3$—$PbTiO_3$ (PST-PT) $Pb(Sc_{1/2}Nb_{1/2})O_3$—$PbTiO_3$(PSN-PT), $BiScO_3$—$PbTiO_3$(BS-PT), $BiYbO_3$—$PbTiO_3$(BY-PT), and the like. Further, various kinds of metals, such as Ir, Pt, tungsten (W), tantalum (Ta), and molybdenum (Mo), may be used for the upper electrode layer 80. In addition, an alloy of the above metals or metal oxides, such as an iridium oxide, may be used.

Furthermore, each upper electrode layer 80 comprising an individual electrode of the piezoelectric element 300 is connected with a lead electrode 90 that extends from near the end of the corresponding ink supply passage 14 onto the insulating layer 55. In one example, the lead electrode 90 is formed of gold (Au).

Furthermore, a protective substrate 30 having a piezoelectric element holding portion 32 is bonded to the substrate 10 by means of adhesive 35. The protective substrate 30 is bonded to an area of the substrate 10 opposite the piezoelectric element 300, and includes a space that does not obstruct the movement of the piezoelectric element 300. In addition, the space of the protective substrate 30 that does not obstruct the movement of the piezoelectric element 300 may be sealed or may not be sealed.

Furthermore, the protective substrate 30 also includes a reservoir portion 31 which faces the communicating portion 13. As described above, the reservoir portion 31 communicates with the communicating portion 13 of the passage forming substrate 10, in order to form a reservoir 100 serving as a common ink chamber for the pressure generating chambers 12. Furthermore, a hole 33 which extends vertically through the protective substrate 30 is provided in a region between the piezoelectric element holding portion 32 and the reservoir portion 31 of the protective substrate 30. A part of the lower electrode layer 60 and a front end of the lead electrode 90 are exposed via the hole 33.

Furthermore, a driving circuit (not shown) is used to drive the piezoelectric element 300, and is fixed on the protective substrate 30. The driving circuit is electrically connected to the lead electrodes 90 through connecting wiring lines formed from conductive wires, such as bonding wires.

The protective substrate 30 is preferably formed from a material having the same coefficient of thermal expansion as the passage forming substrate 10, such as, for example, glass and ceramic materials. In the present embodiment, the protective substrate 30 is formed using a single crystal silicon substrate that is the same material as the passage forming substrate 10.

A compliance substrate 40 configured to include a sealing layer 41 and a fixed plate 42 is bonded onto the protective substrate 30. Here, the sealing layer 41 is formed of a material having flexibility and low rigidity, such as, for example, a polyphenylene sulfide (PPS) film having a thickness of 6 μm. A surface of the reservoir portion 31 is sealed by the sealing layer 41. In addition, the fixed plate 42 is formed of a hard material, such as a metal. In a preferred embodiment the fixed plate 42 is formed from a stainless steel (SUS) having a thickness of 30 μm. Since a region of the fixed plate 42 facing the reservoir 100 includes an opening 43 formed by completely removing a portion of the fixed plate 42, the surface of the reservoir 100 is sealed only by the flexible sealing layer 41.

In an embodiment which includes an ink jet type recording head, ink is supplied from an external ink supply unit (not shown) in order to fill the area from the reservoir 100 to the nozzle openings 21 with ink. Then, the elastic layer 50, the insulating layer 55, the lower electrode layer 60, and the piezoelectric layer 70 are deformed by applying a voltage between the lower electrode layer 60 and the upper electrode layer 80 corresponding to each of the pressure generating chambers 12 in response to a recording signal supplied from a driving circuit. As a result, the pressure within each pressure generating chamber 12 increases and ink droplets are discharged from the nozzle openings 21. In the present embodiment, since the adhesion between the insulating layer 55 and the lower electrode layer 60 is high, the lower electrode layer 60 does not become peeled off even when the actuator device is repeatedly driven. That is, the actuator device according to the present embodiment has excellent durability and reliability.

Figure 4A:
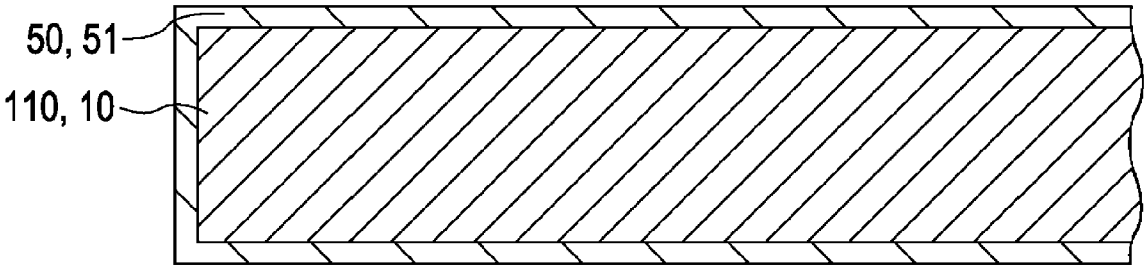
FIGS. 4A-4B are cross-sectional views illustrating a process of manufacturing the recording head according to an embodiment of the invention.

Hereinafter, a method of manufacturing an ink jet type recording head will be described with reference to FIGS. 4A to 8B. In addition, FIGS. 4A to 8B include views illustrating a cross section of a pressure generating chamber in the vertical direction. First, as shown in FIG. 4A, a wafer 110 of passage forming substrate material is thermally oxidized in a diffusion furnace at a temperature of about 1100° C., forming a silicon dioxide layer 51 which comprises the elastic layer 50 on the surface of the wafer 110. In the present embodiment, a silicon wafer having a relatively large thickness of about 625 μm and high rigidity is used as the wafer 110 for the passage forming substrate.

Figure 4B:
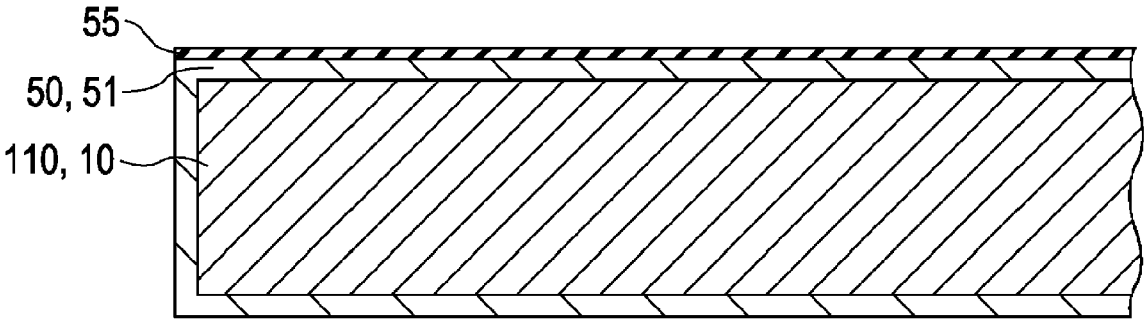

Then, as shown in FIG. 4B, the insulating layer 55 made of a zirconium oxide is formed on the elastic layer 50 (silicon dioxide layer 51). Specifically, a zirconium (Zr) layer is formed on the elastic layer 50 (silicon dioxide layer 51). In one example, the elastic layer 50 is formed using a sputtering method. Then the zirconium layer is thermally oxidized in a diffusion furnace at a temperature of between 500 to 1200° C., thereby forming the insulating layer 55 made of a zirconium oxide ($ZrO_2$).

Figure 5A:
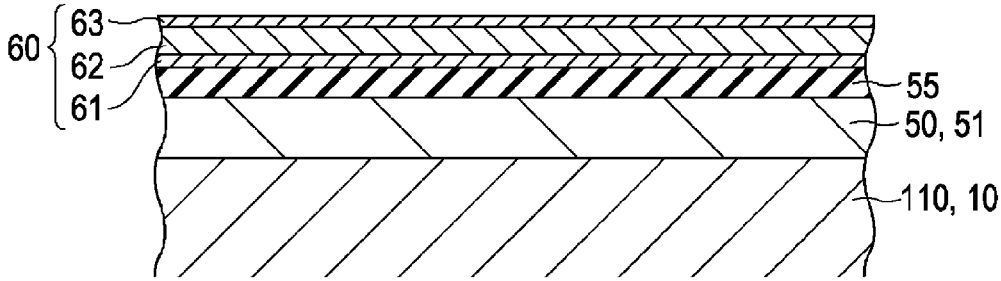
FIG. 5A-5C are cross-sectional views illustrating a process of manufacturing the recording head according to an embodiment of the invention.

Then, as shown in FIG. 5A, the lower electrode layer 60 configured to include a Ti layer 61, a Pt layer 62, and an Ir layer 63 is formed. In one example, the lower electrode layer 60 is formed using a DC magnetron sputtering method. More specifically, the Ti layer 61 made of Ti may be formed on the insulating layer 55 first, followed by the Pt layer 62 made of Pt. Then, the Ir layer 63 made of Ir may be formed on the Pt layer 62. Because the Ir layer 63 is included in this example, it is possible to prevent the Ti ions of the Ti layer 61 from diffusing into the piezoelectric layer 70, and components of the piezoelectric layer 70 may be prevented from diffusing toward the elastic layer 50 when the piezoelectric layer 70 is subsequently formed by baking and crystallizing the piezoelectric layer 70. Instead of the Ir layer 63, other materials may be used, including at least one element selected from a group including palladium (Pd), rhodium (Rh), ruthenium (Ru), and osmium (Os).

Then, a seed titanium layer (not shown) having a predetermined thickness is formed on the lower electrode layer 60 by coating titanium (Ti) once or more (twice in the present embodiment). In the preferred embodiment, the seed titanium layer is formed using a sputtering method such as a DC sputtering method. The seed titanium layer serves as an orientational control layer that controls the orientation of a piezoelectric layer 72 which is formed on the seed titanium layer and becomes the piezoelectric layer 70. Thus, by using an orientational control layer formed of seed titanium and the like, crystal of the piezoelectric layer 72 grows using titanium crystal as a core. As a result, the crystallinity, including the degree of orientation, of the piezoelectric layer 72 is greatly improved. In other embodiments, the orientational control layer may not be used so long as there is no problem with the crystallinity of the piezoelectric layer 70. In configurations where the orientational control layer is used, a layer containing the material used in the orientational control layer may remain between the lower electrode layer 60 and the piezoelectric layer 70 of the manufactured actuator device. For example, when a seed titanium layer is provided as an orientational control layer on the lower electrode layer 60, a residual layer formed of a titanium oxide may remain.

Next, a piezoelectric layer 70 made of a lead zirconate titanate (PZT) is formed on the seed titanium layer. In the present embodiment, a piezoelectric precursor layer 71 is formed by coating and drying a sol, which is obtained by dissolving and dispersing metal organic materials, so result in a gel. In addition, the piezoelectric layer 70 formed of a metal oxide is obtained by baking the piezoelectric layer 70 at high temperature. That is, the piezoelectric layer 70 is formed by using a sol-gel method.

The material of the piezoelectric layer 70 is not limited to the lead zirconate titanate. Other materials, such as piezoelectric materials may be used. For example, a relaxor ferroelectric material (for example, PMN-PT, PZN-PT, PNN-PT, and the like) may be used. Additionally, the piezoelectric layer 70 is may be manufactured using a variety of methods. For example, an MOD (metal-organic decomposition) method, a sputtering method, and the like may be used. Thus, the method of manufacturing the piezoelectric layer 70 is not limited so long as the thin piezoelectric precursor layer is baked and crystallized.

Figure 5B:
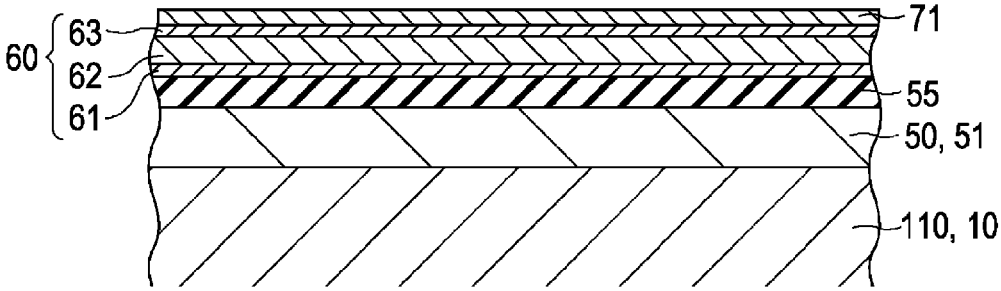

According to the process shown in FIG. 5B, the piezoelectric layer 70 is formed by first forming the piezoelectric precursor layer 71 that is a PZT precursor layer on the lower electrode layer 60. The piezoelectric precursor layer 71 is formed by coating a sol (solution) containing a metal organic compound on the passage forming substrate 10 on which the lower electrode layer 60 is formed (coating process). In the preferred embodiment, the piezoelectric precursor layer 71 has a thickness of about 0.1 μm. Subsequently, the piezoelectric precursor layer 71 is dried for a predetermined period of time by heating at predetermined temperature (drying process). Then, the dried piezoelectric precursor layer 71 is heated at predetermined temperature which is held for a predetermined period of time, such that a degreasing process on the dried piezoelectric precursor layer 71 is performed (degreasing process). In addition, 'degreasing' referred herein means that organic components contained in the piezoelectric precursor layer 71 are separated as $NO_2$, $CO_2$, $H_2O$, and the like.

Figure 5C:
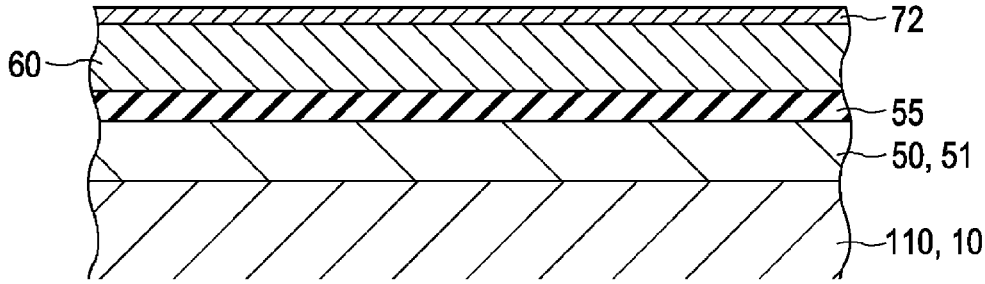

Then, as shown in FIG. 5C, the piezoelectric precursor layer 71 is heated to a predetermined temperature which is held for a predetermined period of time for crystallization, thereby forming the piezoelectric layer 72 (baking process). The heating apparatuses used in the drying process, the degreasing process, and the baking process may include a RTA (rapid thermal annealing) apparatus that performs heating by irradiation of an infrared lamp, a hot plate, and the like.

Figure 6A:
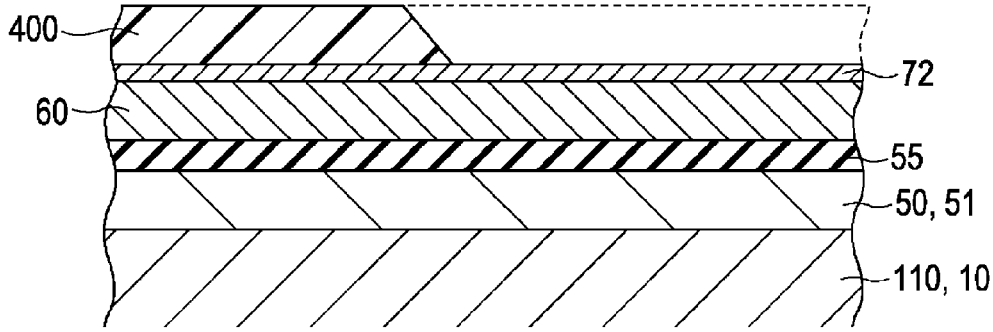
FIG. 6A-6C are cross-sectional views illustrating a process of manufacturing the recording head according to an embodiment of the invention.
Figure 6B:
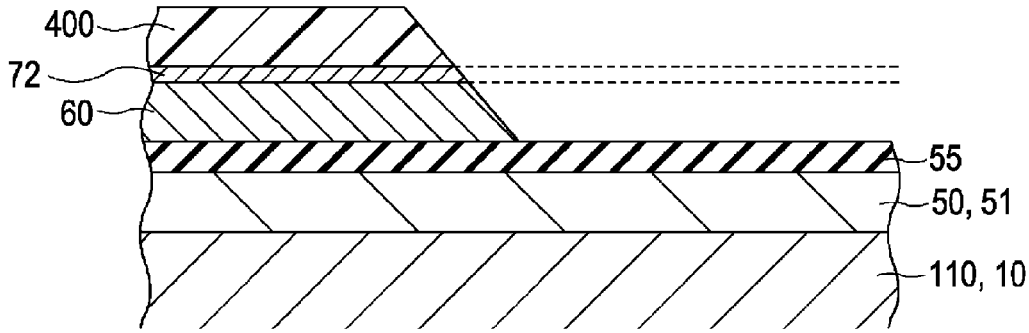

Then, as shown in FIG. 6A, a resist 400 having a predetermined shape is formed on the piezoelectric layer 72. Thereafter, as shown in FIG. 6B, the lower electrode layer 60 and a first layer of the piezoelectric layer 72 are simultaneously formed into a pattern using the resist 400 as a mask such that side surfaces of the layers are inclined.

Figure 6C:
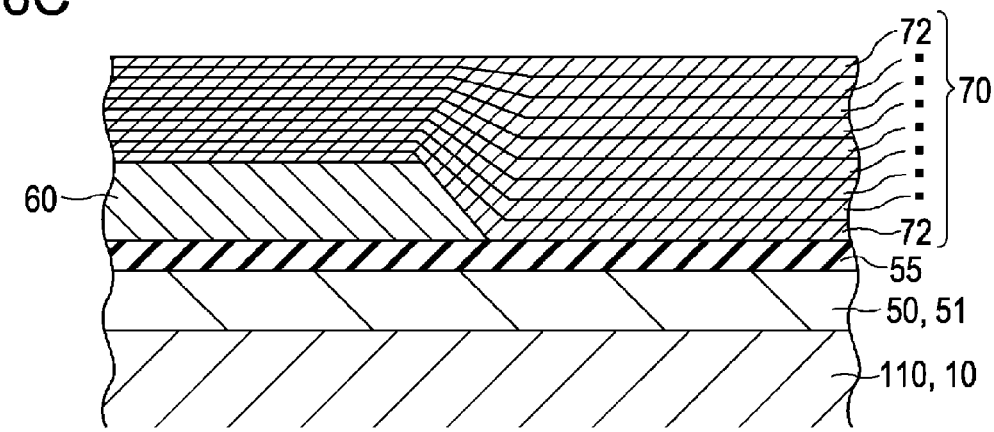

Then, the resist 400 is removed and the process of forming a piezoelectric layer, including a coating process, a drying process, a degreasing process, and a baking process similar to the process described above, is repeated a number of times in order to form the piezoelectric layer 70 which includes the plurality of piezoelectric layers 72. As a result, a piezoelectric layer 70 configured to include a plurality of piezoelectric layers 72 with a predetermined thickness is formed as shown in FIG. 6C. For example, in the case when the layer thickness of a sol for each process is about 0.1 μm, the total thickness of the piezoelectric layer 70 configured to include, for example, ten piezoelectric layers is at a thickness of about 1.1 μm. Although the piezoelectric layer 70 of the exemplary embodiment is formed by laminating a plurality of layers 72, the piezoelectric layer 70 may be formed to have only one piezoelectric layer 72.

In the above-described process of forming the piezoelectric layer 70, the Ti layer 61, the Pt layer 62, and the Ir layer 63 are also heated, such that an alloyed lower electrode layer 60 is formed. In addition, since the metals are oxidized, the lower electrode layer 60 contains oxygen elements. Accordingly, by adjusting the heating conditions and the like, it is possible to adjust the intensity ratio between ions of precious metals and oxygen ions that are detected at near the adjoining surface of the lower electrode layer 60 and the insulating layer 55 by means of the SIMS.

Figure 7A:
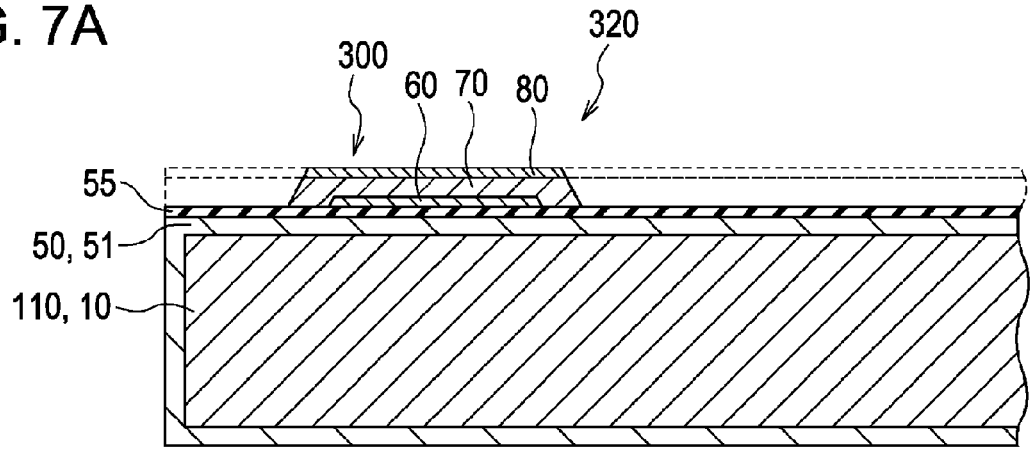
FIG. 7A-7C are cross-sectional views illustrating a process of manufacturing the recording head according to the first embodiment of the invention.

After forming the piezoelectric layer 70, the upper electrode layer 80 made of iridium (Ir) is formed on the entire surface of the piezoelectric layer 70 and is formed into a pattern of regions facing the respective pressure generating chambers 12, thereby forming the piezoelectric element 300 configured to include the lower electrode layer 60, the piezoelectric layer 70, and the upper electrode layer 80, as shown in FIG. 7A. In addition, the piezoelectric layer 70 and the upper electrode layer 80 can be formed using a resist (not shown) of a predetermined shape using a dry etching process. In such dry etching processes, if a side surface of the resist is placed so as to be inclined at the onset of the process, the piezoelectric layer 70 and the upper electrode layer 80 may be formed such that the widths of the piezoelectric layer 70 and the upper electrode layer 80 decrease toward the upper electrode layer 80. Accordingly, side surfaces of the piezoelectric layer 70 and the upper electrode layer 80may be inclined.

Figure 7B:
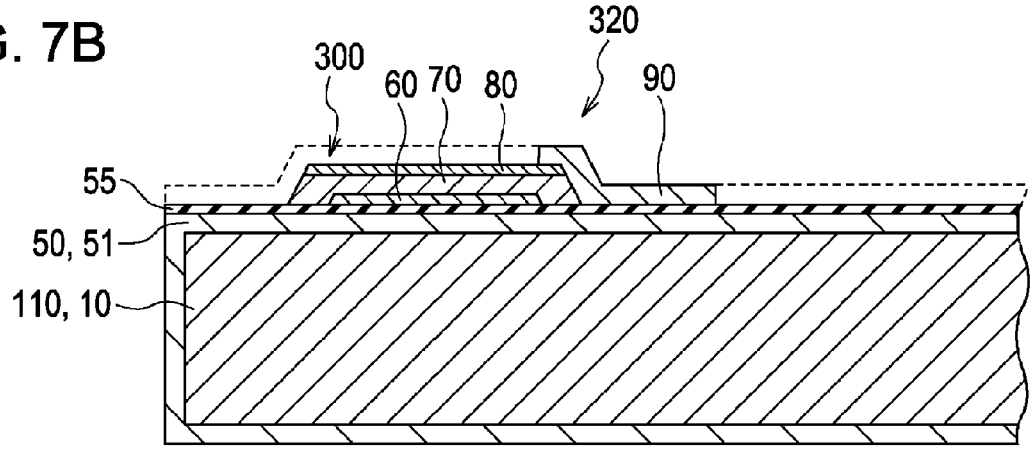

Then, as shown in FIG. 7B, the lead electrode 90 made of gold (Au), for example, is formed on the entire surface of the wafer 110 for a passage forming substrate and is then formed according to a pattern such that a lead electrode 90 is formed for every piezoelectric element 300. In one example the lead electrode 90 is formed using a mask pattern (not shown), such as a resist.

Figure 7C:
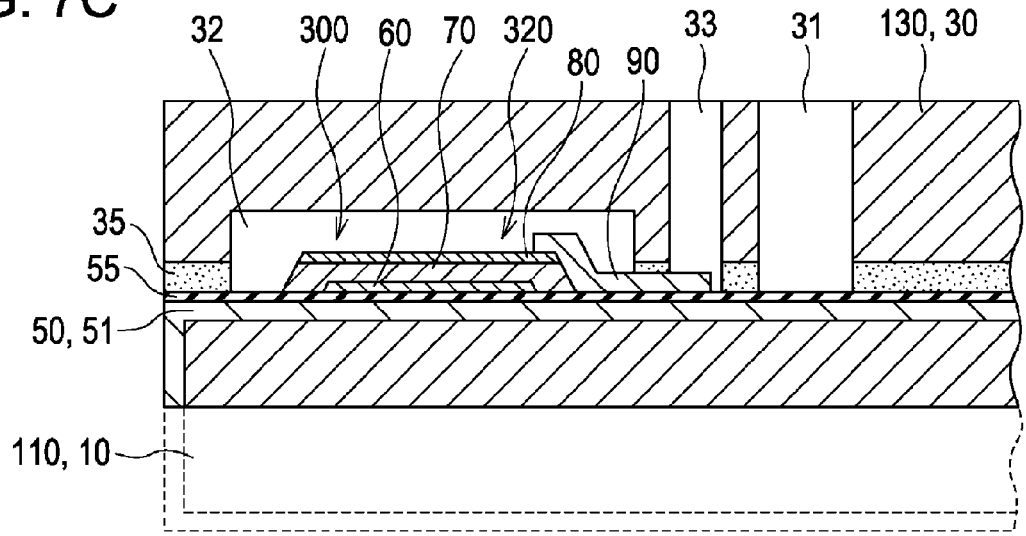

Then, as shown in FIG. 7C, a wafer 130 for a protective substrate, such as a silicon wafer, which is formed so as to include the plurality of protective substrates 30. The wafer 130 is bonded to the piezoelectric element 300 side of the wafer 110 of the passage forming substrate using the adhesive 35. Since the wafer 130 for a protective substrate has a thickness of about 400 μm, for example, the rigidity of the wafer 110 for a passage forming substrate is noticeably improved by bonding the wafer 130 to the wafer 110. After bonding the wafer 130 for a protective substrate to the wafer 110 for a passage forming substrate, the wafer 110 for a passage forming substrate is thinned so as to have a predetermined thickness.

Then, as shown in FIG. 8A, the wafer 110 for a passage forming substrate is thinned until the wafer 110 for a passage forming substrate has a predetermined thickness. Then, a new mask layer 52 is formed on the wafer 110 for a passage forming substrate and is then formed into a pattern so as to have a predetermined shape.

Then, as shown in FIG. 8B, the wafer 110 for a passage forming substrate is subjected to anisotropic etching (wet etching), in which an alkali solution such as KOH is used, using the mask layer 52. As a result, the pressure generating chamber 12, the communicating portion 13, the ink supply passage 14, and the communicating passage 15 corresponding to the piezoelectric element 300 are formed.

Thereafter, unnecessary portions of peripheral edges of the wafer 110 for a passage forming substrate and the wafer 130 for a protective substrate are cut and removed by means of dicing, for example. Then, the silicon dioxide layer 51 provided on a surface of the wafer 110 for a passage forming substrate opposite the wafer 130 for a protective substrate is removed. Next, the nozzle plate 20 which includes the nozzle openings 21 is bonded and the compliance substrate 40 is bonded to the wafer 130 for a protective substrate. Then, the wafer 110 for a passage forming substrate is divided into the passage forming substrates 10, each having a chip size, as shown in FIG. 1, such that the ink jet type recording head according to the present embodiment is obtained.

Hereinafter, a more detailed explanation will be made on the basis of a series of examples.

First Example

An actuator device was manufactured on the basis of the embodiment described above. Specifically, as shown in table 1, the structure of the embodiment before PZT film formation included an $SiO_2$ layer having a thickness of 1 μm and a $ZrO_2$ layer having a thickness of 400 nm. The two layers were sequentially formed on a silicon substrate having a thickness of 625 μm. Next a Ti layer having a thickness of 70 nm, a Pt layer having a thickness of 80 nm, and an Ir layer having a thickness of 10 nm were formed using a sputtering method. Thereafter, a piezoelectric layer made of PZT was formed using a sol having a PZT composition of Pb/(Zr+Ti)=1.18 and Zr/(Zr+Ti)=0.517, with an orientational control layer interposed between each layer. Then, after baking the first piezoelectric precursor layer that is formed using the sol, a baking process was performed three times whenever three piezoelectric precursor layers were formed on the first piezoelectric precursor layer, in order to form a piezoelectric layer having a thickness of 1.1 μm. Each of the four baking processes were performed at 700° C. for five minutes. Then, an upper electrode made of Ir having a thickness of 50 μm was formed on the piezoelectric layer, thereby completing the manufacturing of the actuator device. The configuration of the manufactured actuator device is shown in table 1.

Second Example

An actuator device was manufactured by setting the thickness of a Ti layer to 50 nm.

Third Example

An actuator device was manufactured by setting the thickness of a Ti layer to 20 nm.

First Test Example

Figure 9:
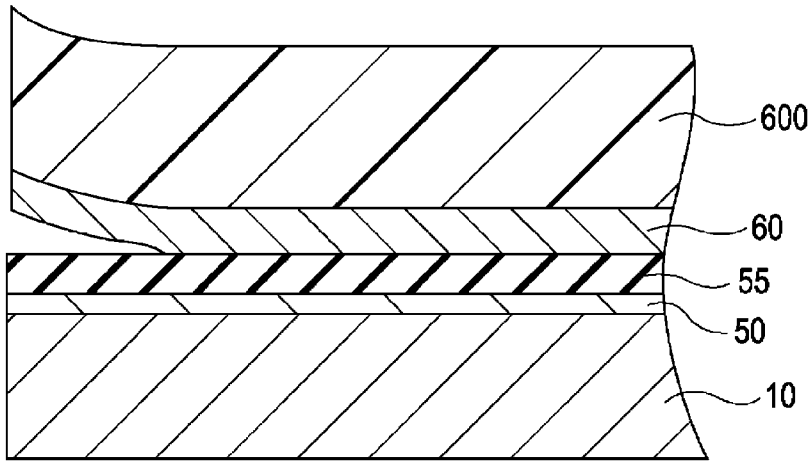
FIG. 9 is a view illustrating a method of a first test example.
Figure 10:
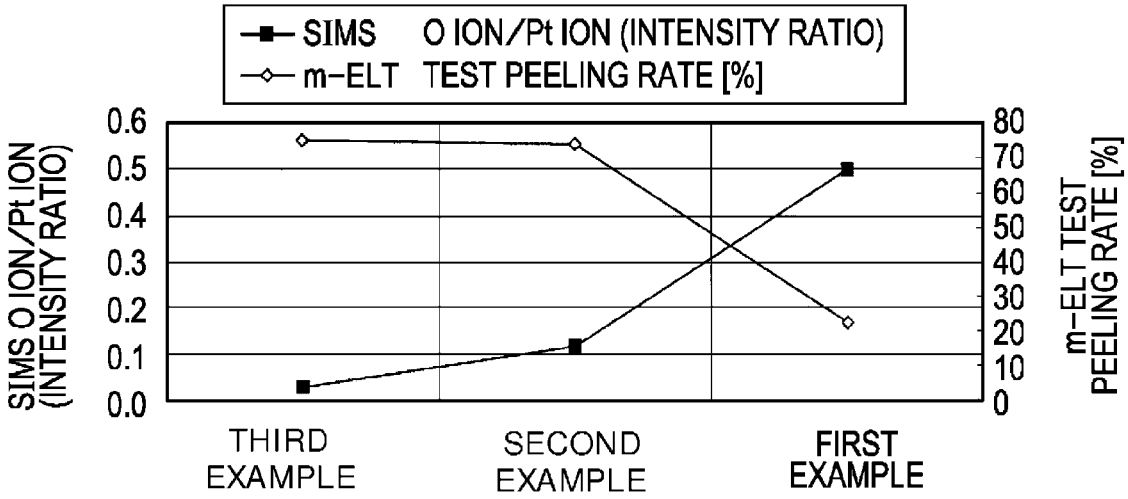
FIG. 10 is a view illustrating results of first and second test examples.

In the actuator devices of the examples, adhesion between a $ZrO_2$ and a lower electrode layer was evaluated using an m-ELT (modified-edge lift off technique) method of the Frontier Semiconductor company. As shown in FIG. 9, first, the piezoelectric layer 70 was stripped from the lower electrode layer 60. Then, an epoxy resin 600 whose residual stress with respect to temperature is guaranteed by the manufacturer is squeegee coated on the lower electrode layer 60 and then cured at 177° C. Then, twenty samples were formed by dividing each silicon substrate into about 1.2 cm squares were obtained. The divided samples were arranged on a measurement plate and set in an apparatus that decreases the temperature from room temperature to −170° C. by 3° C./min. using a liquid nitrogen. In this case, an image indicating whether or not the lower electrode layer 60 peeled off from the insulating layer 55 ($ZrO_2$ layer) was recorded for every temperature decrease of 1° C. using a monitor located above the samples. Then, the number of the divided samples in which the peeling has occurred at 170° C. was recorded. The result is shown in table 1 and FIG. 10.

Second Test Example

Figure 12:
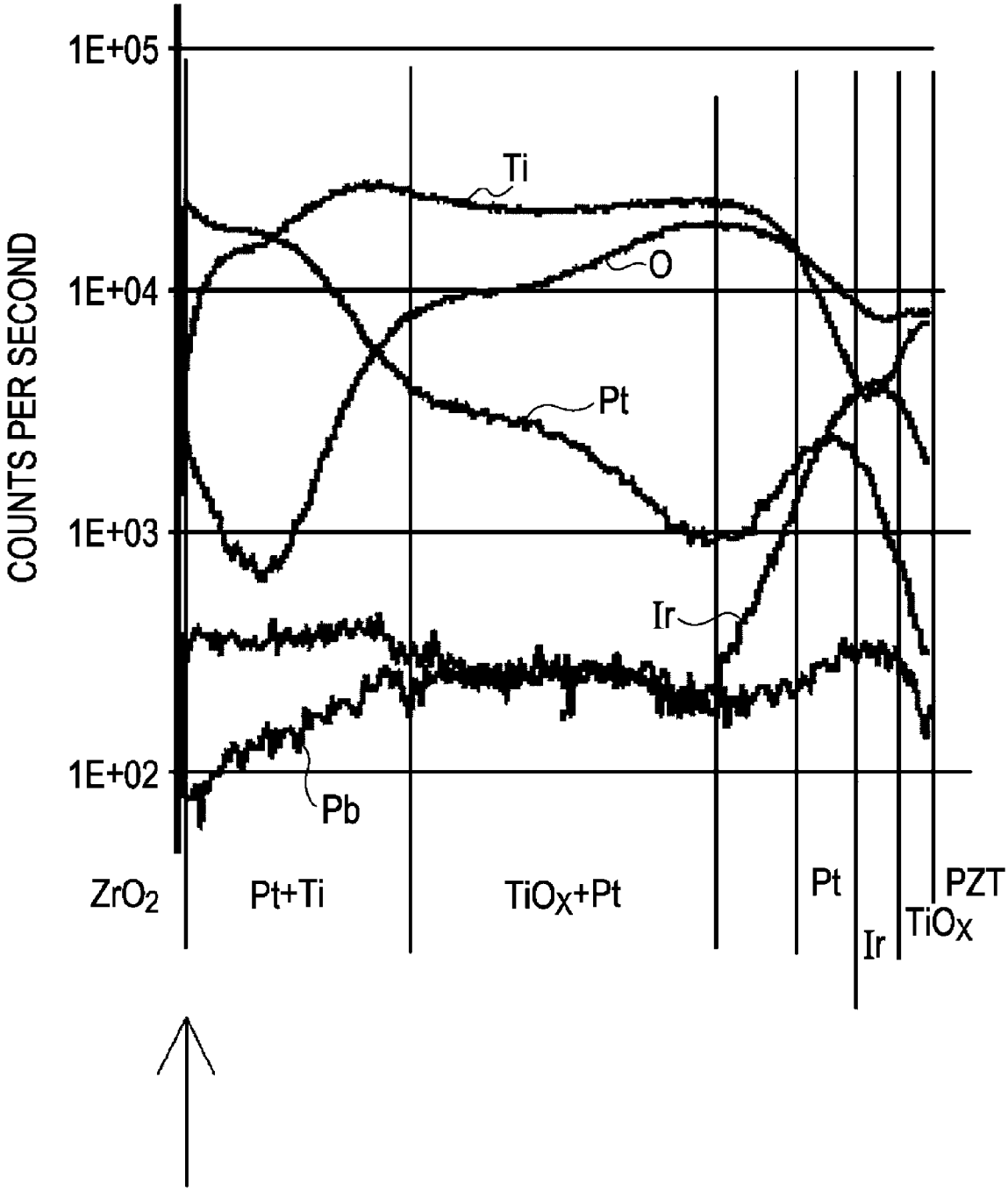
FIG. 12 is a view illustrating a result of measurement of a lower electrode layer using SIMS in a second example.
Figure 13:
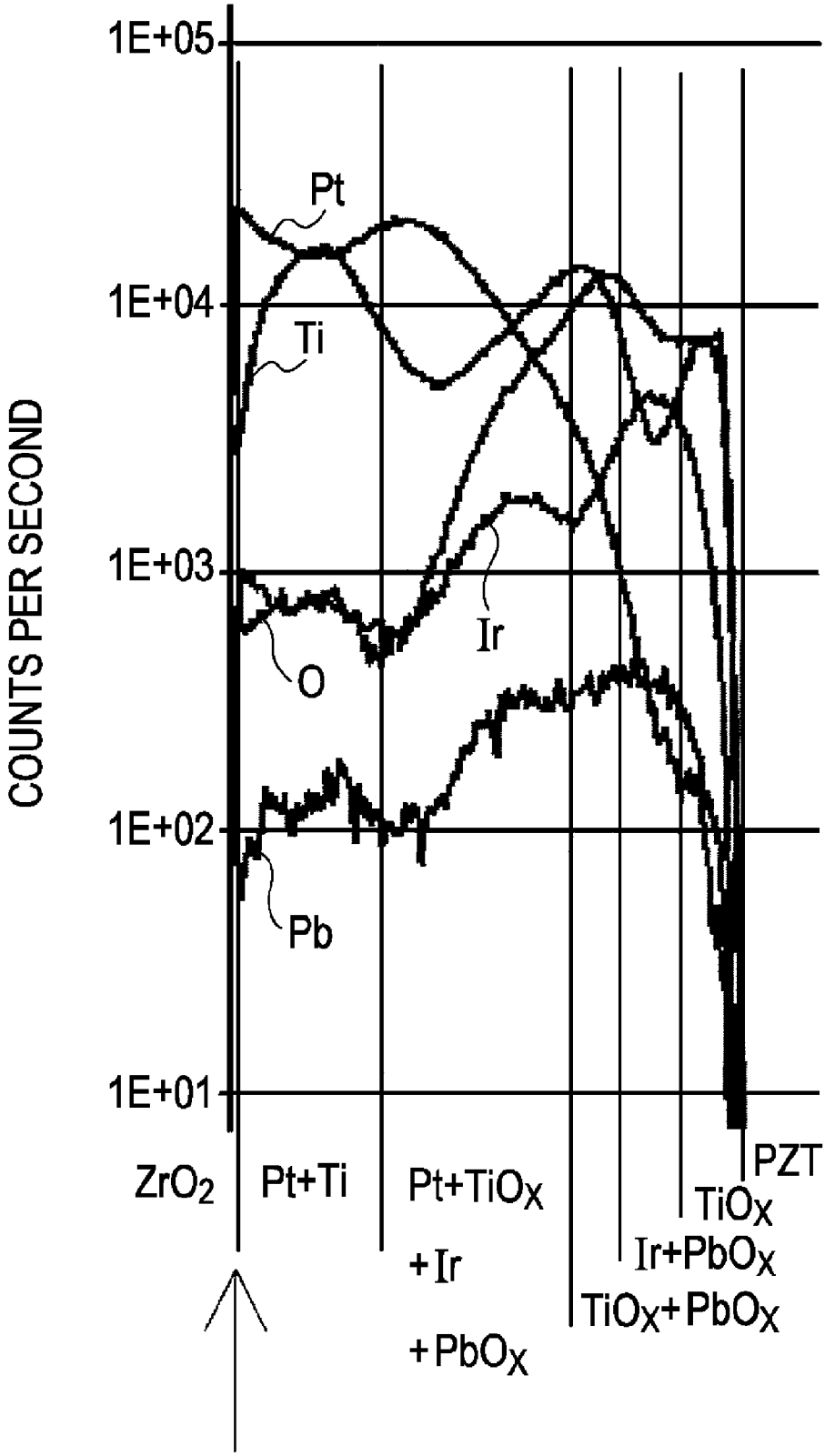
FIG. 13 is a view illustrating a result of measurement of a lower electrode layer using SIMS in a third example.

After the m-ELT test, that is, after the insulating layer 55 ($ZrO_2$ layer) and the piezoelectric layer 70 have peeled off the lower electrode layer 60, a measurement was performed using the secondary ion mass spectroscopy (SIMS). The results corresponding to the first example is shown in FIG. 11, the second example is shown in FIG. 12, and the third example is shown in FIG. 13. In FIGS. 11-13. the left side of the chart corresponds to the area of the insulating layer 55, and the right side corresponds to the area of the piezoelectric layer 70. In FIGS. 11 to 13, O ions/Pt ions (intensity ratio) at the surface and boundary of the lower electrode layer 60 and the insulating layer 55, as indicated by arrow in each of the drawings, was obtained. The result is shown in Table 1 and FIG. 10.

As a result, in the first example, the O ions/Pt ions (intensity ratio) detected at the boundary of the lower electrode layer 60 and the insulating layer 55 ($ZrO_2$ layer) was 0.2 or more, and the peeling rate was very low and adhesion was high compared with the second and third examples. Furthermore, the first example and second example which both included similar layer configurations, including a layer formed of an alloy of Pt and Ti, a layer formed of an alloy of $TiO_X$ and Pt, a layer formed of Pt, and a layer formed of Ir, wherein each layer is provided sequentially from the $ZrO_2$ layer side. Despite the similarities, however, there was a large difference in the peeling rate due to a difference in O ions/Pt ions (intensity ratio).

TABLE 1

| | | first example | second example | third example |
|---|---|---|---|---|
| layer structure before PZT film formation | orientational control layer | Ti 4 nm | Ti 4 nm | Ti 4 nm |
| | | Ir 10 nm | Ir 10 nm | Ir 10 nm |
| | lower electrode layer | Pt 80 nm | Pt 80 nm | Pt 80 nm |
| | | Ti 70 nm | Ti 50 nm | Ti 20 nm |
| | insulating layer | $ZrO_2$ 400 nm | $ZrO_2$ 400 nm | $ZrO_2$ 400 nm |
| | elastic layer | $SiO_2$ 1 μm | $SiO_2$ 1 μm | $SiO_2$ 1 μm |
| | substrate | Si substrate 625 μm | Si substrate 625 μm | Si substrate 625 μm |
| Actuator structure | upper electrode | Ir 50 nm | | Ir 50 nm |
| | piezoelectric body | PZT 1.1 μm | | PZT 1.1 μm |
| | | $TiO_x$ | | $TiO_x$ |
| | orientational control layer | Ir | | Ir + $PbO_x$ |
| | | Pt | | TiOx + PbOx |
| | lower electrode layer | $TiO_x$ + Pt | | Pt + $TiO_x$ + Ir + PbOx |
| | | Pt + Ti | | Pt + Ti |
| | insulating layer | $ZrO_2$ 400 nm | | $ZrO_2$ 400 nm |
| | elastic layer | $SiO_2$ 1 μm | | $SiO_2$ 1 μm |
| | substrate | Si substrate 625 μm | | Si substrate 625 μm |
| first test example peeling rate | | 22% | 74% | 75% |
| second test example O ion/Pt ion (intensity ration) | | 8912 cps/17782 CPS = 0.501 | 2660 cps/22387 CPS = 0.119 | 668 cps/23713 CPS = 0.028 |

In addition, even if the thicknesses of the silicon substrate, and the subsequent layers is modified, the high adhesion can be obtained so long as the O ions/Pt ions (intensity ratio) is 0.2 or more. In addition, the PZT composition is not also limited to the configuration described in the first example.

Other Embodiments

Having described one exemplary embodiment of the invention, the basic configuration of the invention is not limited to that in the first embodiment described above. For example, although the ink jet type recording head has been described as an example of a liquid ejecting head that may be used in association with the invention, the invention may be widely applied to various kinds of liquid ejecting heads. Accordingly, it is needless to say that the invention may be applied to liquid ejecting heads that eject liquids other than ink. For example, other liquid ejecting heads include various kinds of recording heads used in image recording apparatuses such as printers, color material ejecting heads used in manufacturing color filters such as liquid crystal displays, electrode material ejecting heads used in forming electrodes for organic EL displays and FEDs (field emission displays), and bioorganic material ejecting heads used in manufacturing biochips. In addition, the invention may be applied not only to actuator devices mounted in liquid ejecting heads (ink jet type recording heads and the like) but also to actuator devices mounted in all kinds of apparatuses.

What is claimed is:

1. An actuator device comprising:

a piezoelectric element comprising a base layer forming a vibrating plate provided on a surface of a substrate, a lower electrode provided the base layer, a piezoelectric layer provided on the lower electrode, and an upper electrode provided on the piezoelectric layer;

wherein the lower electrode is comprised of a precious metal;

wherein the ratio $Z_1/Z_2$ between the intensity $Z_1$ of oxygen ions and the intensity $Z_2$ of ions of the precious metal detected at a surface of the lower electrode facing the substrate is 0.2 or more when a cross-section of the lower electrode is examined using secondary ion mass spectroscopy (SIMS), and wherein the base layer is comprised of at least one material selected from a the group of $SiO_2$, $ZrO_2$, and $Zr_{1-x}M_xO_y$ (where $0.01 \leqq X \leqq 0.15$, $Y=2.0\pm\alpha$, $\alpha$ is a stoichiometrically allowed value, and M is an IIA group element, an IIIA group element, or an IIIB group element).

2. The actuator device according to claim 1, wherein the base layer is comprised of $ZrO_2$ and includes a columnar crystal plane having an average crystal grain diameter of 20 to 100 nm oriented in the (−111) direction.

3. The actuator device according to claim 1, wherein the base layer is comprised of $ZrO_{1-x}M_xO_y$, and the 'M' is comprised of at least one element selected from Y and Ca.

4. A liquid ejecting head including a liquid discharging unit that ejects liquid comprising the actuator device according to claim 1.

5. An actuator device comprising:

a piezoelectric element comprising a base layer comprising a vibrating plate provided on a surface of a substrate and a lower electrode is provided on the base layer, a piezoelectric layer provided on the lower electrode, and an upper electrode provided on the piezoelectric layer;

wherein the lower electrode is comprised of a precious metal;

wherein the ratio $Z_1/Z_2$ between the intensity $Z_1$ of oxygen ions and the intensity $Z_2$ of ions of the precious metal detected at a surface of the lower electrode facing the base layer is 0.2 or more when a cross-section of the lower electrode is examined using secondary ion mass spectroscopy (SIMS); and wherein the base layer is comprised of at least one material selected from a the group of $SiO_2$, $ZrO_2$, and $Zr_{1-x}M_xO_y$ (where $0.01 \leqq X \leqq 0.15$, $Y=2.0 \pm \alpha$, $\alpha$ is a stoichiometrically allowed value, and M is an IIA group element, an IIIA group element, or an IIIB group element.

6. The actuator device according to claim 5, wherein the base layer is comprised of $ZrO_2$ and includes a columnar crystal plane having an average crystal grain diameter of 20 to 100 nm oriented in the (−111) direction.

7. The actuator device according to claim 5, wherein the base layer is comprised of $Zr_{1-x}M_xO_y$, and the 'M' is comprised of at least one element selected from Y and Ca.

8. A liquid ejecting head including a liquid discharging unit that ejects liquid comprising the actuator device according to claim 5.

* * * * *